United States Patent [19]

Kohlhagen

[11] 4,148,488

[45] Apr. 10, 1979

[54] RANDOM SELECTION APPARATUS

[76] Inventor: Walter Kohlhagen, 818 Oakley Ave., Elgin, Ill. 60120

[21] Appl. No.: 695,929

[22] Filed: Jun. 14, 1976

[51] Int. Cl.[2] ..... A63F 9/04

[52] U.S. Cl. ..... 273/146

[58] Field of Search ..... 273/146, 138 R, 138 A, 273/144 B, 145 C, 1 L, 161; 272/8 R, 8 N, 8 D; 40/106.1, 106.21, 69, 70, 71, 72, 28 R, 28 C, 152; 46/41, 42; 215/12 R

[56] References Cited

U.S. PATENT DOCUMENTS

| | | | |
|---|---|---|---|
| 484,115 | 10/1892 | Saxton | 273/145 C |
| 717,803 | 10/1904 | Bishop | 33/379 |
| 1,654,248 | 12/1927 | Erdmann | 33/348 |
| 2,452,730 | 11/1948 | Carter | 273/145 C |
| 2,746,757 | 5/1956 | Frost | 273/145 C X |
| 3,049,814 | 8/1962 | McLain | 35/70 |
| 3,119,621 | 1/1964 | Bookman | 273/145 C |
| 3,168,315 | 2/1965 | Bookman | 273/145 C |
| 3,286,358 | 11/1966 | Smokowski | 33/364 |
| 3,655,197 | 4/1972 | Milbaum | 273/138 R |
| 3,785,651 | 1/1974 | Smith | 273/146 X |
| 4,049,277 | 9/1977 | Carlsson, Jr. et al. | 273/145 C |

FOREIGN PATENT DOCUMENTS

| | | | |
|---|---|---|---|
| 1806553 | 5/1970 | Fed. Rep. of Germany | 273/146 |
| 337747 | 2/1904 | France | 273/138 R |
| 968830 | 5/1950 | France | 273/146 |

*Primary Examiner*—William H. Grieb
*Assistant Examiner*—Arnold W. Kramer
*Attorney, Agent, or Firm*—Lowe, King, Price & Becker

[57] ABSTRACT

A die includes a first, sealed cube having six transparent, window forming faces. A second cube within the first cube has six insignia bearing faces, each in register with and in relatively close proximity to a corresponding face of the first cube. An optical shielding liquid within the container fills the container so that when the die is at rest a transparent bubble is formed between an upper, horizontally disposed insignia bearing face and the container face in registration with the upper face. The shielding liquid obscures all of the other insignia bearing faces. In a second embodiment, a randomly selected, upper face of a polyhedron, buoyant in an optical shielding liquid, is guided so that it is close to, but spaced from, and in registration with a horizontally disposed window on an upper wall of a sealed container for the liquid by guide walls of the container, as well as bosses on the polyhedron. The shielding liquid fills the container so that a transparent bubble is formed between the upper face and container window. In both embodiments, the bubble is confined between the upper container window and the upper, insignia bearing face to wipe the shielding liquid from the window and face, thereby enabling the insignia to be clearly seen.

33 Claims, 12 Drawing Figures

RANDOM SELECTION APPARATUS

FIELD OF INVENTION

The present invention relates generally to random selection devices and more particularly to a random selection device employing an optical shielding liquid for insignia bearing faces of a polyhedron.

BACKGROUND OF THE INVENTION

Random selection devices, such as dice, are employed in many games of chance. Several random selection devices employing liquids for optically shielding or obscuring all but one insignia bearing face of a polyhedron have been suggested. However, to my knowledge only one such device has been commercially introduced; this device is disclosed in Bookman Pat. Nos. 3,119,621 and 3,168,315. In many respects, the commercially available device is similar to other proposed devices, since they include a shielding liquid that substantially fills a sealed container containing a polyhedron or die having insignia bearing faces. An insignia of the prior art commercial device is rendered visible through a transparent, upper window of the container when the polyhedron is buoyed upwardly so that insignia defining projections on the face come to rest in contact with the transparent window. Amongst the problems that exist with the commercially available device is that insignias on the polyhedron are frequently difficult to discern because the insignia bearing faces do not come to rest completely against the transparent window. In such an event, the shielding liquid may obscure the insignia from a viewer. Also, the insignia is frequently not easily seen through the window even when the polyhedron comes to rest in a position wherein the insignia is in contact with the window.

It is, accordingly, an object of the present invention to provide a new and improved random selection device including a container for an optical shielding liquid that obscures from view all but one insignia on a polyhedron.

Another object of the invention is to provide a new and improved random selection device wherein an insignia bearing face of a polyhedron, at rest, is invariably positioned in an optically shielding liquid so that the face is easily viewed through a horizontal, upper window of a sealed container for the liquid and polyhedron.

It is another object of the invention to provide a new and improved random selection device including a polyhedron in a container including an optically shielding liquid wherein an insignia bearing face of the polyhedron, at rest, is invariably in a position parallel to an upper horizontally extending window of the container, so that the insignia can be always easily viewed through the window.

BRIEF DESCRIPTION OF THE INVENTION

In accordance with one aspect of the invention, a random selection device includes a sealed container having a relatively flat window means. A polyhedron within the container includes multiple insignia bearing faces, one of which is randomly displayed to an observer through a horizontally disposed portion of the window means when the polyhedron is at rest. An optical shielding liquid fills the container such that when the polyhedron is at rest, the face carrying the displayed insignia lies in registration with and close to, but spaced from, the horizontally disposed portion of the window means. Thereby, the liquid obscures from view the insignias on all of the insignia bearing faces except the displayed insignia on an upper, substantially horizontally disposed face of the polyhedron. Since the liquid does not cover the upper polyhedron face, the entire upper polyhedron face is visible to an observer because a transparent fluid (preferably air) having a density less than the shielding liquid subsists between the insignia bearing face and the window.

In one form the shielding liquid fills the container so that the transparent fluid is formed as a bubble in the liquid, which bubble subsists between the polyhedron face bearing the displayed insignia and the horizontal portion of the window means. The bubble has a volume such that it is confined between the horizontally disposed portion of the window means and the upper face to display any liquid having a tendency to adhere to the window means in proximity to the displayed face and upper face. The bubble forces or wipes the liquid away from the face and window, thereby to provide a clear view of the insignia to an observer. To conceal the undisplayed portion of the polyhedron, its faces preferably have the same color as the shielding liquid color, except for the insignia which are preferably a highly reflecting color, such as white.

In accordance with one embodiment of the invention, the random selection device is a die comprising an inner polyhedron having N indicia bearing faces and an outer polyhedron having N window carrying faces in registration with the insignia bearing faces. Preferably the inner and outer polyhedrons are cubes so that $N=6$. The outer polyhedron has, at the rest position of the die, a pair of parallel, substantially horizontal faces that respectively form a lower supporting face and an upper face through which the displayed insignia on the upper face of the inner polyhedron is viewed. The outer polyhedron is a sealed container for the shielding liquid which flows in spaces between the faces of the inner and outer polyhedrons, whereby all insignias on the inner polyhedron, except the insignia on the upper face are obscured. When the die is at rest, fluid flows from a space between the displayed face and the upper container face to the spaces between the other insignia bearing faces and the other container faces.

Preferably, the faces of the inner polyhedron are maintained in fixed relation to the container faces, although the inner polyhedron may float in the liquid. In the preferred fixed construction, each corner of the insignia bearing polyhedron is fixedly mounted to a corner of the container and a beveled face exists between adjacent insignia bearing faces of the inner polyhedron to provide flow paths for the fluid between the faces of the inner and outer polyhedrons. To provide additional fluid flow between the adjacent faces and enable the insignia on the displayed face to be displayed even though the die is at rest so that the upper and lower faces are not exactly horizontal, but are tilted to a certain extent (as great as $\pm 30°$ from the horizontal for a die formed as a cube), each interior corner of the container is tilted at an acute angle; for a cube, the tilt angle is approximately 15° to 20° from a right angle.

In accordance with another embodiment of the invention, the insignia bearing polyhedron floats freely in a shielding liquid maintained in a sealed container having a volume enabling different insignia bearing polyhedron faces to be in proximity to a single, horizontal window on an upper face of the container. To direct the insignia bearing polyhedron toward the window, the container includes a sloping wall arrangement that tapers toward the window. The container face carrying the window preferably has an area only slightly in excess of the area of an insignia bearing face of the polyhedron to cause the insignia bearing face to be maintained in a plane parallel to the window. To prevent insignia on the displayed face from contacting the window and prevent the polyhedron from catching or hanging up on a corner between the sloping wall and the window carrying face of the container, a boss is provided on at least some of the faces, preferably the faces of the polyhedron.

It is, accordingly, still another object of the invention to provide a new and improved die.

It is a further object of the invention to provide a die including an optical shielding liquid which readily flows to all insignia bearing faces, except an upper, horizontally disposed, displayed face.

In order to be commercially acceptable, the shielding liquid is nontoxic so that container leaks do not cause illness to a person using the device. Also, the liquid remains in the liquid state from approximately −40° F. to approximately 150° F. to prevent bursting of the container in response to expansion of the liquid due to freezing or pressure increases due to the liquid boiling. The susceptibility of the container bursting in response to expansion of the shielding liquid as a function of temperature is reduced because the transparent fluid provides an expansion volume for the liquid. Further, the liquid should have a low internal surface tension so that it does not bubble and froth in response to agitation, thereby enabling the upper insignia to be quickly seen when the polyhedron comes to rest. These desiderata for the shielding liquid are achieved by mixing approximately equal volumes of distilled (deionized) water and grain alcohol that is miscible with the water. The water and alcohol mixture is combined with a dye, such as a food dye, to form a soluble solution of a dark blue or black color to provide an opaque liquid shield. It is to be understood, however, that the liquid shield can be any suitable liquid that absorbs, reflects, or refracts visible light; in certain instances the shielding liquid can even be slightly transparent to provide a smoky appearance.

It is an additional object of the invention to provide a new and improved random selection device employing a shielding liquid that is arranged in a sealed container so that it provides improved visibility to and does not obscure an insignia on a face of a polyhedron, when the insignia is at rest in proximity to an upper, horizontally disposed window of the container.

A further object of the invention is to provide a new and improved random selection device employing a liquid optical shield that is nontoxic, remains liquid over a wide temperature variation, and has a relatively low internal surface tension so that it does not bubble or froth and does not obscure an insignia bearing face which is desired to be displayed when the device is at rest.

Another object of the invention is to provide a new and improved random selection device employing an optical shielding liquid wherein the visibility of an indicia bearing face through a window of a sealed container is enhanced because there is virtually no tendency for the liquid to remain in the volume between the insignia and window when the device is at rest.

The above and still further objects, features and advantages of the present invention will become apparent upon consideration of the following detailed description of several specific embodiments thereof, especially when taken in conjunction with the accompanying drawing.

DETAILED DESCRIPTION OF THE DRAWING

Figure 1:
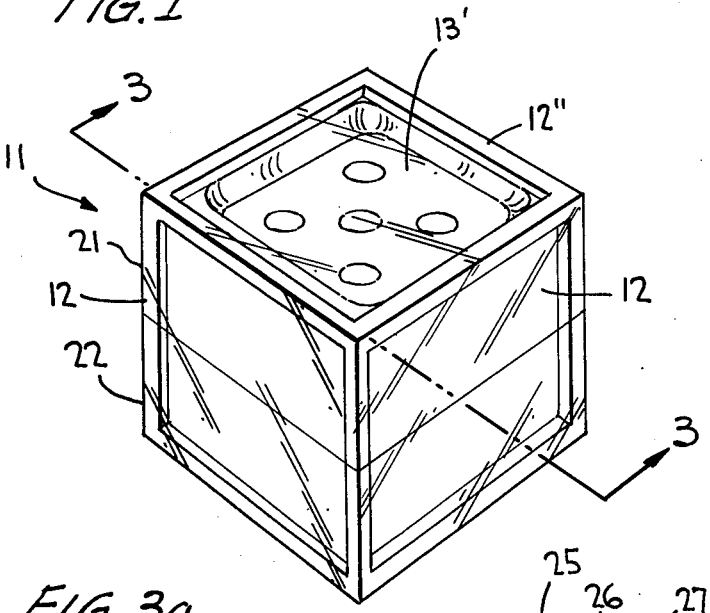
FIG. 1 is a perspective view of a die in accordance with one embodiment of the invention.

Reference is now made to FIGS. 1–4 of the drawing wherein there is illustrated a die in accordance with one embodiment of the present invention. The die includes an outer, plastic container 11 that is sealed to prevent liquid from flowing out of it and is preferably formed as a cube 11 having six transparent, flat faces 12, each of which forms a window to enable one of the six, substantially flat, insignia bearing faces 13 of an inner plastic or sheet metal cube 14 to be viewed when the die is at a rest position. Corresponding faces 12 and 13 of cubes 11 and 14 are always maintained in register with each other since inner cube 14 is fixedly mounted relatively to outer cube 11. A space is provided between corresponding, parallel faces 12 and 13 of cubes 11 and 14 and fluid flow paths are provided between these adjacent spaces by beveled faces 15 that extent at an angle of 45° between adjacent faces 13 of inner cube 14 so that a mass 16 of optical shielding fluid flows from one space to another when the die is agitated. Thereby, between adjacent beveled faces 15, at each corner of cube 14, there is formed an inclined flat surface 15' which allows small bubbles in the shielding fluid to rise to the uppermost portion of the shielding fluid. While surface 15' is preferably flat, it is to be understood that this surface is not necessarily flat, but could be curved. At all rest positions of the die, there are lower and upper horizontal faces 12 and 13 of the outer and inner cubes 11 and 14. The lower horizontal face of cube 11 (in FIG. 3 the lower face is designated 12') supports the die on a substantially horizontal surface, while the upper face of cube 14 (the upper face of cube 14 is designated 13' in FIGS. 1–4) carries insignia 20 that is viewed by an observer through the window formed by the upper face of cube 11 (the upper face of cube 11 is designated as 12'').

To obscure all of the indicia bearing faces, except for the indicia on the displayed upper face 13 of cube 14 when the die is at a rest position, optical shielding liquid 16 fills container 11 in the spaces between the vertical faces 12 and 13 and the space between the lower faces 12' and 13 of cubes 11 and 14. The upper face 13' of cube 14 is rendered visible through upper window 12'', when the die is at rest, because an air bubble 17 exerting force subsists throughout the space between upper face 13' of die 14 and the interior face or wall 18 of the upper face 12'' of cube 11. The volume between faces 13' and 18 and the volume of liquid 16 are such that bubble 17 extends downwardly for a short distance below the upper, horizontal face 13' of cube 14 along the vertically extending spaces between the outer and inner cubes 11 and 14 so that meniscuses 19 are formed along the vertical faces or walls of cubes 11 and 14. Because bubble 17 is confined between upper face 13' of cube 14 and face 18 and thereby is not allowed to assume a spherical or ellipsoidal shape, but has a smaller height than a sphere or ellipsoid that it has a natural tendency to assume it exerts sufficient force on these faces to displace and wipe away the more dense shielding liquid that has a tendency to adhere to these faces. Thereby, insignia 20 on the upper face 13 of cube 14 is rendered clearly visible to an observer through the window on the upper face 12 of cube 11.

The volume of liquid 16 relative to the space between cubes 11 and 14 is such that the tendency of bubble 17 to attain a spherical shape is prevented and the bubble is forced into a shape having greater than normal surface area between upper face 13' and interior face 18. The confined shape of bubble 17 exerts a force against upper face 13 and interior face 18; the force against faces 13 and 18, as well as the force gravity exerts on liquid 16, in forming meniscuses 19, pushes opaque globules of liquid 16 to the side, into the space between the vertical faces between cubes 11 and 14 to provide a clear view of the insignia on upper, displayed face 13. The unconfined volume of bubble 17 should exceed the volume of the space between upper face 13 and interior face 18 to wipe these faces clean of the opaque liquid globules. Thereby, bubble 17 is effectively forced into a shape having greater surface area than if it was not constricted. The fluid restriction formed along beveled faces 15 increases the hydrostatic pressure of bubble 17 against upper face 13 and interior face 18 to wipe the opaque liquid globules from these faces.

While air is preferably used to form bubble 17, it is to be understood that the bubble can be formed of any transparent fluid that is less dense than shielding liquid 16; when the die comes to rest the fluid must quickly form a bubble between upper faces 12 and 13 to wipe liquid from these faces. Also, it is not necessary in all embodiments to fill container 11 with so much of the liquid 16 that bubble 17 forms. It is necessary for the container to be filled sufficiently to cover all of the insignia on the side and bottom faces of cube 11.

Optical shielding liquid is preferably non-toxic so that no deleterious effects will occur if there is a leak in container 11; liquid 16 must have low internal surface tension so that: (a) it does not bubble and froth extensively when the die is agitated and, (b) as the die comes to rest after being tossed any bubbles that arose during agitation should quickly disband to provide clear visibility for the insignia and entire upper face quickly assumes a rest condition, without bubbles, as the die comes to rest after being tossed. Shielding liquid 16 is a non-wetting liquid relative to the plastic material of cubes 11 and 14 so that the liquid easily flows from the space between upper face 13 and interior face 18 and does not obscure the insignia on the upper face.

I have found that an opaque liquid meeting these criteria can be formed of a mixture of approximately equal, 50% parts, by volume, of distilled (deionized) water and an alcohol that can be mixed with water, preferably grain alcohol; after a small amount of black or dark blue dye, such as a food dye, is added to the mixture, the three constituents are homogeneously mixed to form a liquid solution so that the dye is completely dissolved in the mixture of water and alcohol. While liquid 16 is preferably opaque, it is to be understood that the shielding liquid can be reflective or refractive and in certain instances even smoky in color, as long as the other criteria for the liquid are observed.

To enable the insignia on upper face 13 to be easily viewed, cube 14 is formed of the same dark color as opaque liquid 16 and the insignia on faces 13 are painted white so that they are clearly visible and in contrast with the black or dark background of the shielding liquid and faces 13 of cube 14. The insiginas are flat or indented on faces 13 and in the preferred embodiment are formed as dots. It is not desirable for the insignias to be raised away from the remainder of faces 13 and in contact with the interior walls of faces 14 because the optical effect of bubble 17 would be eliminated and the insignias on the vertical faces 13 of cube 14 would be visible.

Inner cube 14 is fixedly maintained relative to container 11 by physical contact at each corner 23 of inner cube 14 to intersections 25 of each pair of adjacent channels 26 that run the length of the inside of each of the interior edges of cube 11. Four mutually orthogonal channels 26 are provided to form an open lattice defining the outline of a cube. In one form, each of channels 26 is opaque and has an extent inwardly from its intersection with edges 24 of cube 14 beyond the intersection between beveled faces 15 and insignia bearing faces 13. Thereby, the beveled faces 15 cannot be perceived by a viewer looking through upper, horizontal, transparent face 12 and no visible optical path is presented to the viewer from the upper face to the side faces of cube 12. Only the insignia on the upper face 13 is visible to the viewer when he looks into a square area defined by the inner edges 27 of channels 26.

To enable the insignia on an upper face of cube 14 to be visible even though the die comes to rest at a position displaced by up to $\pm 30°$ from the horizontal, edges 28 of channels 26 are tilted about 15° to 20° from the plane of the exterior face of cube 11 that runs in generally the same direction as edges 28. In response to the die being supported, at rest, on a surface that is $\pm 30°$ from the horizontal, the tilt of edges 28 and the 45° bevel of faces 15 enable bubble 17 to be maintained completely within the volume between the upper face 13 of cube 14 and the interior upper face 18 of container 11. While the meniscus 19 drops to a lower level between the walls of cubes 11 and 14 that are toward the lower edge of the die, to provide a larger transparent area along this edge, the larger transparent area is not usually noticed because of the difficulty in observing the lower edge.

Figure 3A:
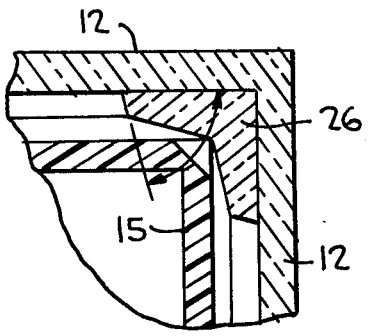
FIG. 3*a* is a side view of a modified form of the die.
Figure 3:
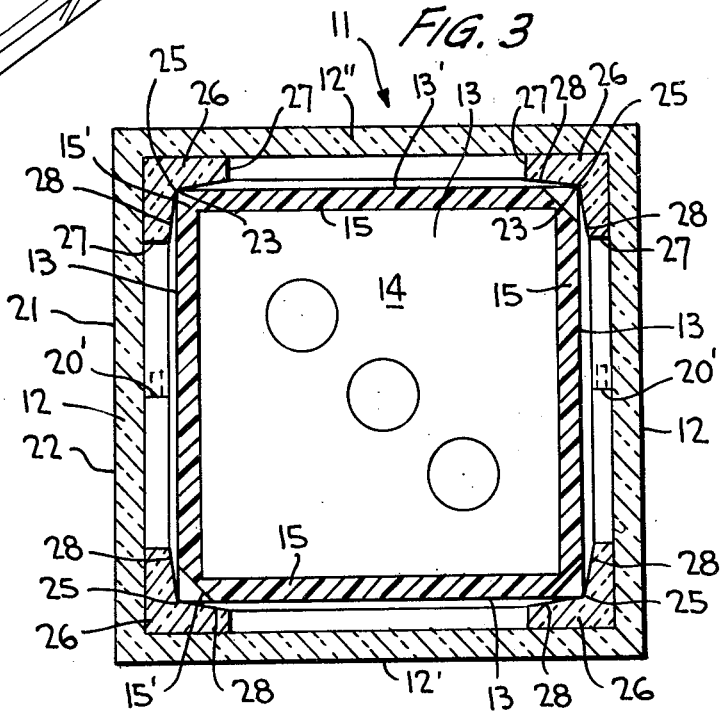
FIG. 3 is a side view of the die, taken through the lines 3—3, FIG. 1.
Figure 4:
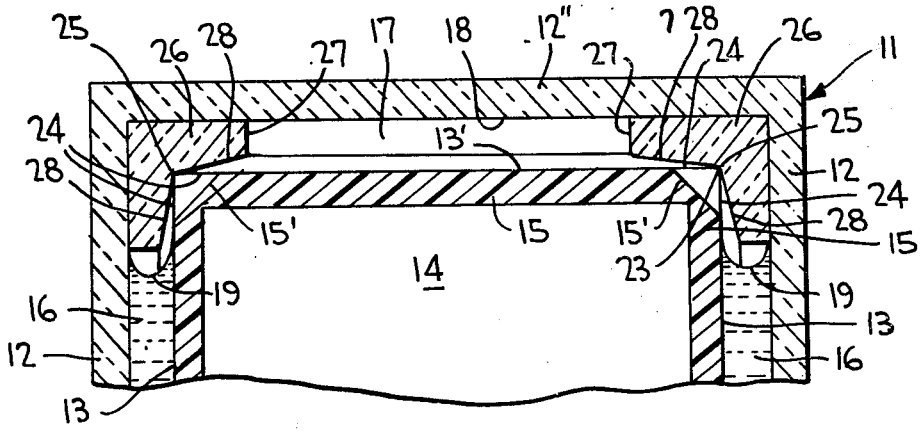
FIG. 4 is an enlarged view of a top portion of the die, particularly illustrating the formation of a transparent bubble.
Figure 2:
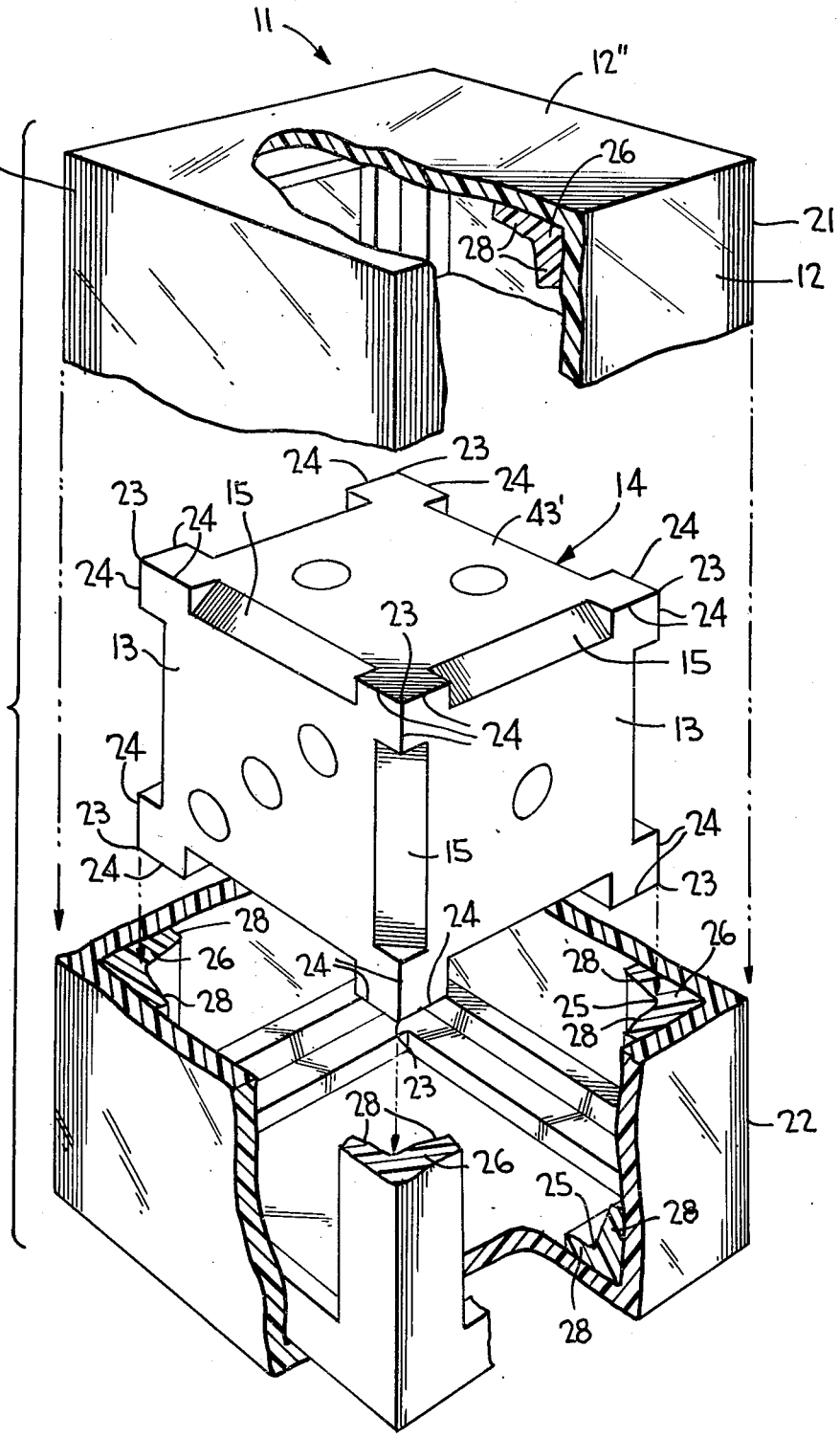
FIG. 2 is an exploded view of the die.
Figure 6:
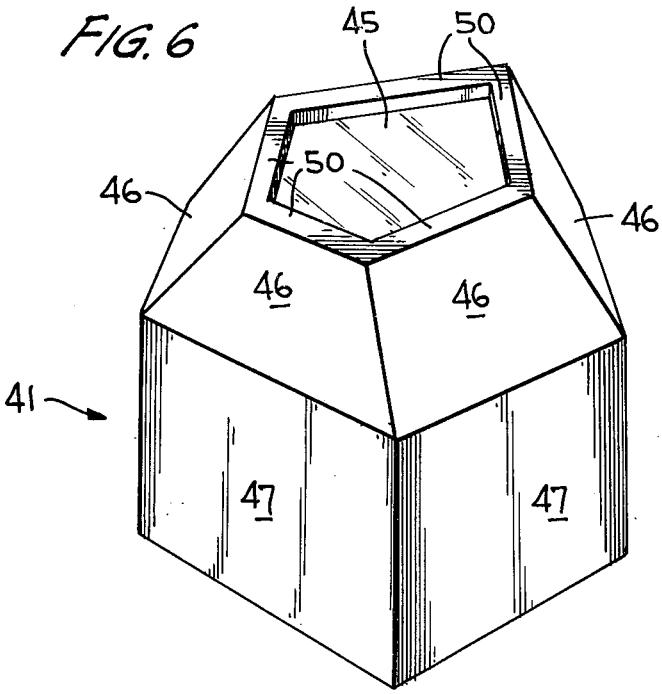
FIG. 6 is a perspective view of a second embodiment of the present invention.

In the embodiment of FIGS. 3 and 4, each of inner edges 27 of channels 26 intersects face 12 which it abuts at an angle of 90°. In an alternate embodiment, illustrated in FIG. 3*a*, the angle is less than 90°, being between approximately 75° and 90°; if the edge 27 makes an angle of less than 90° with its abutting face, the edge tilts toward the corner to which it is closest. The sharp angle of edges 27 relative to faces 12 causes bubble 17 to latch into place as the die is tipped even though the tipping has a tendency to greatly increase bubble area. This is because the bubble resists being forced into the small area where the sharp corners between edges 27 and faces 12 exist, since the bubble has a tendency to assume a spherical or ellipsoidal form having a smooth perimeter, directly opposite to the sharp intersection between the edges and faces. The 45° angle of surfaces 15' prevents small air bubbles from being trapped between the lattice and faces 12 after the die has been agitated since the small bubbles readily rise into large bubble 17.

In one preferred construction, inner cube 14 is formed from a planar metal or plastic sheet that is folded into the form of a cube. To this end, the sheet includes four, contiguous square panels. Extending in opposite directions from the two square panels at opposite ends of the sheet is a pair of square panels, having ears projecting in opposite directions, away from the four contiguous panels. The panels are folded and the ears are tucked in to form the inner cube 11.

In manufacture, container 11 may be formed as a transparent five sided box having an open face through which a dark colored lattice including channels 26 is inserted. The lattice is divided into two identical parts that are keyed together by pins 20'. In the alternative, channels 26 can be molded to the faces of the box, in which case the transparent lattice appears to the viewer to have the same color as dark liquid 16. The liquid is poured through the open face into the box to a height to enable bubble 17 to be formed when the open face is covered by bonding a further transparent face in situ. If channels 26 are molded to the box, they are molded to the further face to complete the lattice.

Figure 5:
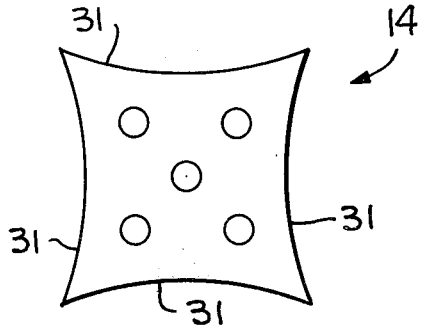
FIG. 5 is a side view of an alternate form of an inner cube that can be used in the die.

Certain modifications can be made in the die of FIGS. 1-4. In particular, faces 13 need not be planar and extend parallel to the interior faces of container 11; instead, cube 14 can be provided with symmetrically concave faces 31, as illustrated in FIG. 5. The concave faces provide a simple means of spacing the insignia away from the window, and if the bubble is confined into a shape that increases its surface area, proper wiping will occur. This also enables easier and faster liquid run-off from the upper insignia bearing face so that the insignia becomes visible quickly after the die comes to rest.

As a further modification, the inner cube can be buoyant, and float in liquid 16 rather than be fixed within container 11. In one embodiment, the size of the floating inner cube, relative to the space within container 11, is such that corresponding faces of the inner and outer cubes remain in registration and spaced from each other regardless of the position and agitation of the die. In another embodiment the floating inner cube is considerably smaller than the outer cube so that the inner cube is free to rotate relative to the outer cube when the die is agitated or "rolled". When the die comes to rest, the inner cube is buoyed so that the displayed upper face is guided into registration with, but spaced from, the upper face of the outer cube. Guiding of the inner cube is augmented by providing the outer cube with sloping interior walls between each pair of adjacent faces thereof; the interior walls have a 45° slope with respect to each of the faces between which it extends. It is also to be understood that the die need not be a cube, nor a regular polygon, in all instances. If, for example, it is desired to provide a die having twelve insignia bearing faces, the principles of the invention could be extended to an inner regular polygon having twelve faces and an outer regular polygon having a like number of faces that are maintained in registration with the insignia bearing faces of the inner polygon. Also, if it is desired to enable certain faces of the die to have a greater probability of being in an upper horizontal position, the sizes of the faces can be different from each other. It is, however, essential that the die, when at rest, have pairs of opposite, lower and upper, horizontal faces so that the lower face functions as a base for the die while the upper face displays an insignia.

Reference is now made to FIGS. 6-9 and 11 of the drawing wherein there is illustrated a second embodiment of a random selection device in accordance with the invention. The random selection device includes outer, plastic, generally opaque container 41 that is sealed to prevent liquid from flowing out of it. Within container 41 there is a regular, twelve sided polyhedron or die 42 that floats in a mass 43 of optical shielding liquid. Liquid 43 fills container 41 to form a bubble 44 against the upper interior surface of container 41. When container 41 is at rest, its base 40 is in a lower horizontal position and an insignia on an upper face of polyhedron 42 is displayed through the bubble and upper, transparent window 45 of the container. Liquid 43 and bubble 44 have the same characteristics as liquid 16 and bubble 17 of the embodiment previously described.

Container 41 has a volume below window 45 sufficient to enable polyhedron 42 to tumble in the container when the container is agitated by being turned on its side or in an upside down position. After container 41 has been so agitated and has been returned to its rest position, an insignia bearing face of the polyhedron floats up toward and in proximity to window 41 and then is guided so that the insignia and face are in a plane parallel to and spaced from the window 45.

To guide die 42 into the stated rest position, container 41 includes a plurality of tapered sides 46 or has a frusto conical side wall. In the embodiment shown, the number of sides 46 equals the number of edges on each face forming die 42; for the specific embodiment illustrated, each face is a regular polygon having five edges, i.e., a regular pentagon. Tapered sides 46 extend between window 45 and vertical, side walls 47, having sufficient length and spacing to form a volume to enable tumbling of polyhedron 42. The inclination angles between walls 46 and 47 are approximately the same or somewhat greater than the inclination angle between adjacent faces of die 42. Thereby, when container 41 is at rest the faces of die 42 that extend outwardly and downwardly from window 45 lie substantially parallel to tapered walls 46. Alternatively the walls 46 of the container 41 may be frusto conical and the inclination angle may be equal to, or somewhat greater than, the adjacent faces 7, the die 42, to provide the desired result. The spacing between walls 46 and the outwardly and downwardly extending sides of die 42 must be great enough to enable the die to rotate into the rest position in the likely event of die 42 being buoyed toward window 45 at an angle such that the upper face of the die is not initially parallel to the interior face of window 45.

Figure 10:
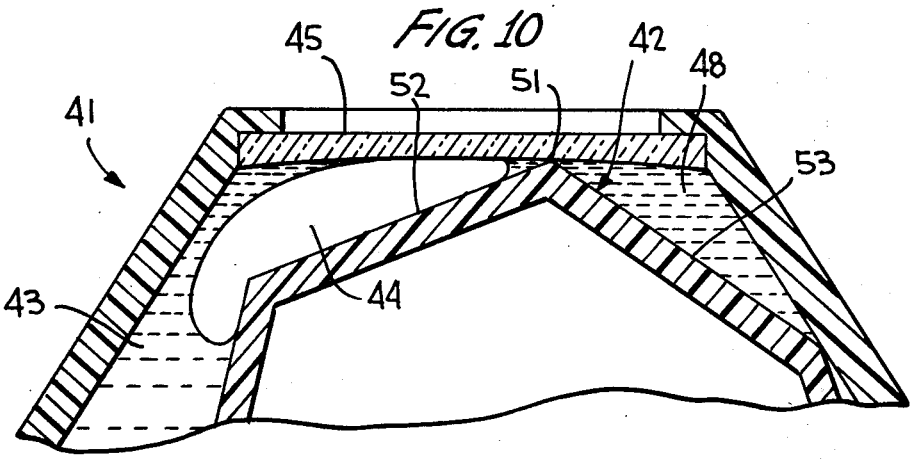
FIGS. 10 and 11 are respectively illustrations of the possible malfunctioning and correct operation of a random selection device illustrated in FIG. 6 as dies excluding bosses at its corners and with bosses at its corners approach a window of an exterior container of the device.

However, because of the hydrostatic forces between bubble 44 and die 42, there is a relatively high probability that die 42 will "hang up" as it approaches window 45 if the die has only flat edges as in FIG. 10. Such "hang up" occurs because bubble 44 resists being forced to assume to a very small height in the vicinity between the contacting upper edge 51 of die 42 and the interior of window 42. In this region, bubble 44 exerts sufficient hydrostatic force on die 42 to substantially equalize the buoyant force of the die so that the die position tends to be stabilized to prevent the die from moving parallel to window 45.

Figure 11:
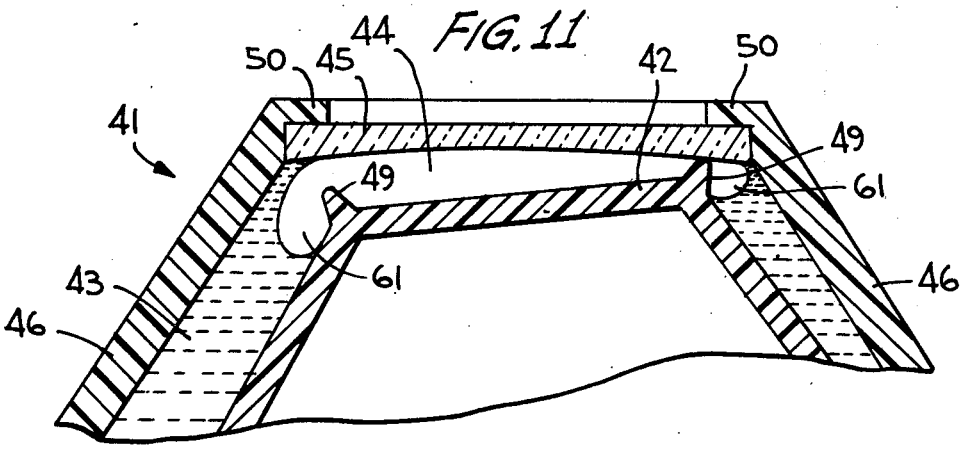

To avoid the "hang up" illustrated in FIG. 10, bosses or projections 49 are provided at each corner of die 42. Bosses 49 enable air bubble 44 to extend around the upper face of die 42, as well as the faces of the die that extend outwardly and downwardly from the upper face, as the die approaches window 45, as illustrated in FIG. 11. There is no opportunity for a liquid mass, such as liquid mass 48 (FIG. 10), to be captured on one side of the upper edge of the die since projection 49 has a relatively small volume projecting above the highest edge of die 42, whereby bubble 44 easily flows about the projection. In other words, there is no confined liquid volume to one side of the upper side and air bubble 44 has an opportunity to flow into the cavities extending downwardly from the upper edge and face of die 42 as the die approaches window 45.

Figure 8:
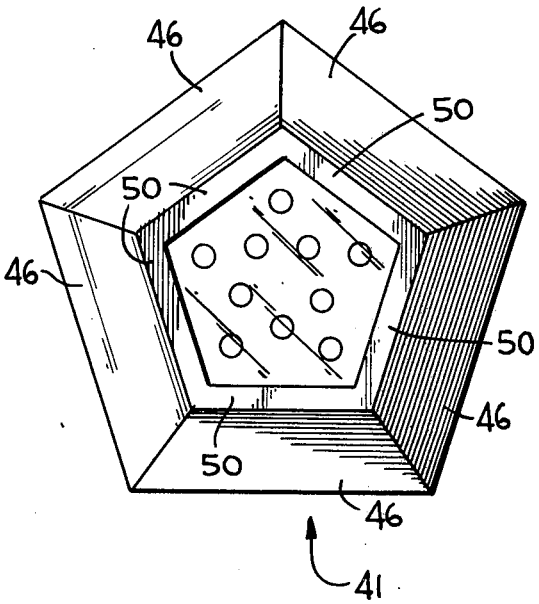
FIG. 8 is a top view of the device illustrated in FIG. 6.
Figure 7:
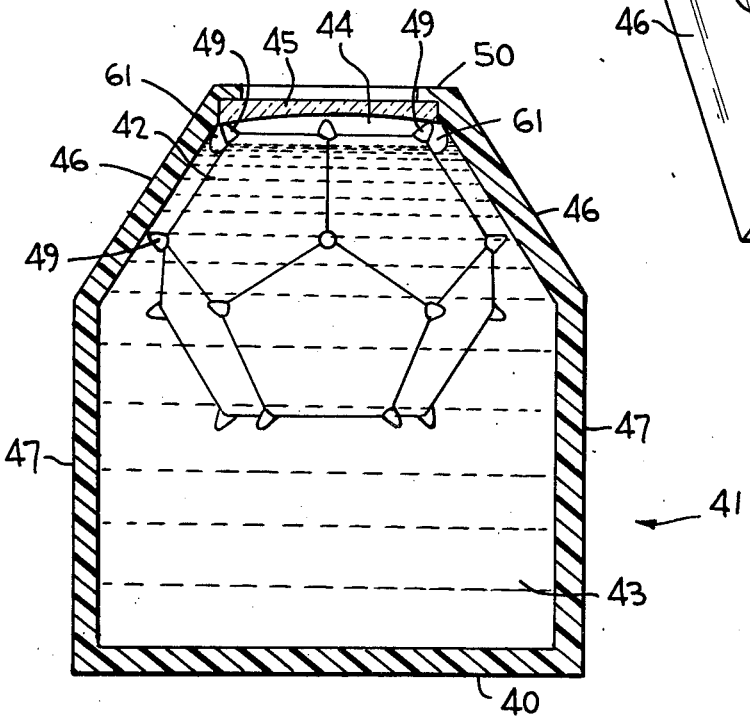
FIG. 7 is a side section view, taken through the random selection device illustrated in FIG. 6.
Figure 9:
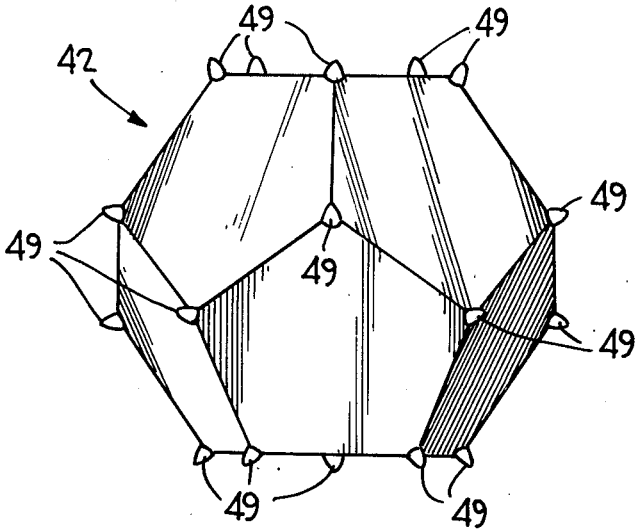
FIG. 9 is a side view of a die utilized in the embodiment of FIG. 6.

In the rest position die 42 is rotated so that its upper face is generally parallel to the interior face of window 45, with the edges of the upper face of the die being in general alignment with the upper edges of tapered walls 46, as illustrated in FIG. 8. Most of the upper face of die 42 is rendered visible to an observer through bubble 44 and window 45. The edges of the upper die face and the projections 49 extending from it are obscured by opaque lips 50 that extend horizontally toward window 45 from the upper edge of walls 46. The remaining faces of die 42 are rendered invisible by shielding liquid 43, that fills the interior of container 41 except for the volume occupied by bubble 44, which extends slightly downwardly along the side walls of the die that project from the upper face of the die, to form meniscuses 61. The downward extent of meniscuses 61, however, is such that none of the indicia on the side faces of die 42 are visible; the volume of meniscuses 61 and the length of projections 49 are such that bubble 44 exerts sufficient hydrostatic pressure to wipe any globules of liquid 43 from the upper face of die 42 and the interior of window 45. The interior surface of window 45 is concave to provide better drainage of shielding liquid 43 from the window, thereby to render the insignia on the upper face of die 42 more clearly visible.

While there have been described and illustrated several specific embodiments of the invention, it will be clear that variations in the details of the embodiments specifically illustrated and described may be made without departing from the true spirit and scope of the invention as defined in the appended claims. For example, the applicable modifications mentioned with regard to FIGS. 1–4 and FIG. 5 can be applied to the embodiment of FIGS. 6–11. Particularly, die 42 need not be a regular polyhedron, but can be an irregular polyhedron having faces with different numbers of edges and differing areas.

What is claimed is:

1. A die comprising a sealed polyhedron container having a plurality (N) of faces each of which carries a window, a polyhedron within the sealed container having the same number of faces as the container, each face of said polyhedron bearing an insignia, each face of the polyhedron being maintained in register with and spaced from a different one of the window carrying faces while the die is at rest, said container being configured so that for each rest position of the die there are two substantially horizontal faces of the container, said horizontal faces being upper and lower faces of the container, an optical shielding liquid within said container, the container, liquid, faces and insignia being such that when the die is at rest the liquid obscures from view the insignias on all of the insignia bearing faces except the insignia on the upper, substantially horizontal face of the polyhedron.

2. The die of claim 1 wherein the liquid fills the container so that when the die is at rest, a transparent fluid volume is provided between the upper horizontal face of the polyhedron and container, whereby the insignia on the upper face is displayed through the transparent volume and the window on the container face in register with the upper polyhedron face.

3. The die of claim 2 wherein the spacing between the container and polyhedron is such that the corresponding faces of the container and polyhedron are always maintained in register regardless of the position and agitation of the die.

4. The die of claim 3 further including fluid flow paths between adjacent spaces formed between the polyhedron and container faces in register so that the liquid flows from the space between the upper polyhedron face and the container face in register with the upper polyhedron face to others of said spaces.

5. The die of claim 4 wherein the polyhedron faces are maintained fixed relative to the container faces.

6. The die of claim 4 wherein each corner of the polyhedron is fixedly mounted to a corner of the container and a beveled face is provided on the polyhedron between adjacent insignia bearing faces of the polyhedron to form the fluid flow paths.

7. The die of claim 6 wherein each interior corner of the container is tilted at an acute angle so that the transparent fluid remains between the upper face and the container face in register with it even though the upper face is tilted substantially from the horizontal.

8. The die of claim 7 wherein the tilt angle is about 15°.

9. The die of claim 8 wherein the polyhedron is regular and $N=6$.

10. The die of claim 1 wherein the liquid fills the container so that when the die is at rest a bubble is formed between the upper face and the container face in register with the upper face, said bubble having a volume such that when the die is at rest (a) substantially the entire upper face can be viewed through the bubble and the window on the container face in register with the upper face and (b) the bubble exerts sufficient force on the upper face and the window on the container face in register with the upper face to displace any liquid having a tendency to adhere to the upper face and the window.

11. The die of claim 10 wherein the spacing between the container and polyhedron is such that the corresponding faces of the container and polyhedron are always maintained in register regardless of the position and agitation of the die.

12. The die of claim 11 further including fluid flow paths between adjacent spaces formed between the polyhedron and container faces in register so that the liquid flows from the space between the upper polyhedron face and the container face in register with the upper polyhedron face to others of said spaces.

13. The die of claim 12 wherein the polyhedron faces are maintained fixed relative to the container faces.

14. The die of claim 12 wherein each corner of the polyhedron is fixedly mounted to a corner of the container and a beveled face is provided on the polyhedron between adjacent insignia bearing faces of the polyhedron to form the fluid flow paths.

15. The die of claim 14 wherein each interior corner of the container is tilted at an acute angle so that the bubble remains between the upper face and the container face in register with it even though the upper face is tilted substantially from the horizontal.

16. The die of claim 15 wherein the tilt angle is about 15°.

17. The die of claim 16 wherein N=6.

18. The die of claim 1 wherein the liquid has a relatively low internal surface tension.

19. The die of claim 1 wherein the liquid has a freezing temperature of approximately −40° F. and a boiling temperature of at least +150° F.

20. The die of claim 1 wherein the liquid has a relatively low internal surface tension and a freezing temperature of approximately −40° F. and a boiling temperature of at least 150° F.

21. The die of claim 20 wherein the liquid includes a mixture of approximately 50% by volume of water and approximately 50% by volume of an alcohol that is miscible with the water.

22. The die of claim 1 wherein the polyhedron faces are maintained fixed relative to the container faces.

23. The die of claim 22 wherein N=6.

24. A random selection device comprising a sealed container having relatively flat window means at least a portion of which is adapted to be substantially horizontally disposed, a single polyhedron within the container having multiple insignia bearing faces one of which is randomly displayed to an observer through the horizontally disposed portion of the window means when the polyhedron is at rest, an optical shielding liquid within said container, the liquid, faces and insignia being such that when the polyhedron is at rest the face carrying the displayed insignia lies in a plane substantially parallel to and in close proximity to the horizontally disposed portion of the window means so that the liquid obscures from view the insignias on all of the insignia bearing faces except the displayed insignia, the displayed insignia being on an upper face of the polyhedron, the liquid being of a material and filled in the container so that when the polyhedron is at rest a single transparent, fluid bubble is formed in the liquid between the face carrying the displayed insignia and the horizontal portion of the window means, said single bubble having a predetermined volume such that substantially the entire face carrying the displayed insignia can be viewed through the bubble and the horizontally disposed portion of the window means, the spacing between the face carrying the displayed insignia and the horizontal portion of the window means being relatively close, so that the bubble is confined between them and is not allowed to assume its normal spherical or ellipsoidal shape, but has a smaller height than either an sphere or ellipse, to exert a sufficient force on the horizontally disposed portion of the window means and the face carrying the displayed insignia to displace any liquid having a tendency to adhere to the horizontally disposed portion of the window means in proximity to the displayed face and the face carrying the displayed insignia, wherein the container is a second polyhedron having the same number of faces as the insignia bearing polyhedron, corresponding faces of the two polyhedrons being maintained in register while the container is at rest, said window means being provided on each face of the second polyhedron to enable each of the insignias to be displayed when the face carrying the insignia is the upper horizontal face.

25. The device of claim 24 wherein the polyhedron is buoyant in the liquid.

26. The device of claim 24 wherein the spacing between the container and polyhedron is such that the corresponding faces of the container and polyhedron are always maintained in register regardless of the position and agitation of the device.

27. A die comprising a first, sealed cube having six window forming faces, a second cube within the first cube having six insignia bearing faces, each of the window forming faces being spaced from and in register with a different one of the insignia bearing faces, corresponding ones of the insignia bearing and window forming faces being in relatively close proximity to each other and lying in substantially parallel planes so that they are always in register with each other, an optical shielding liquid within said first cube, the first cube, liquid, faces and insignia being such that when the die is at rest with one of the faces substantially horizontal the liquid obscures from view the insignias on all of the insignia bearing faces except the insignia on an upper substantially horizontal face of the second cube.

28. The die of claim 27 wherein the liquid fills the container so that when the die is at rest a bubble is formed between the upper face and the container face in register with the upper face, said bubble having a volume such that when the die is at rest (a) substantially the entire upper face can be viewed through the bubble and the window on the container face in register with the upper face and (b) the bubble exerts sufficient force on the upper face and the window on the container face in register with the upper face to displace any liquid having a tendency to adhere to the upper face and the window.

29. The die of claim 24 wherein the liquid has a relatively low surface tension.

30. The die of claim 24 wherein the liquid has a freezing temperature of approximately −40° F. and a boiling temperature of at least +150° F.

31. The die of claim 24 wherein the liquid has a relatively low internal surface tension and a freezing temperature of approximately −40° F. and a boiling temperature of at least 150° F.

32. The die of claim 24 wherein the liquid includes a mixture of approximately 50% by volume of water and approximately 50% by volume of an alcohol that is miscible with the water.

33. The die of claim 24 wherein the horizontally disposed portion of the window means has an area slightly in excess of the area of the upper face of the polyhedron.

* * * * *